US009340384B2

(12) United States Patent
Yabuki et al.

(10) Patent No.: US 9,340,384 B2
(45) Date of Patent: May 17, 2016

(54) SHEET FEEDER AND IMAGE FORMING APPARATUS

(71) Applicant: KONICA MINOLTA, INC., Cihiyoda-ku, Tokyo (JP)

(72) Inventors: Shinichi Yabuki, Toyokawa (JP); Shoichi Yoshikawa, Okazaki (JP); Atsuhiko Shimoyama, Tahara (JP); Noboru Oomoto, Toyokawa (JP); Ryo Oshima, Anjo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/832,789

(22) Filed: Aug. 21, 2015

(65) Prior Publication Data

US 2016/0068358 A1 Mar. 10, 2016

(30) Foreign Application Priority Data

Sep. 4, 2014 (JP) ..... 2014-179791

(51) Int. Cl.

| | |
|---|---|
| ***G03G 15/00*** | (2006.01) |
| ***B65H 7/16*** | (2006.01) |
| ***B65H 5/00*** | (2006.01) |
| ***B65H 3/08*** | (2006.01) |
| ***B65H 7/14*** | (2006.01) |
| ***B65H 3/14*** | (2006.01) |
| ***B65H 5/22*** | (2006.01) |

(52) U.S. Cl.

CPC .. *B65H 7/14* (2013.01); *B65H 3/14* (2013.01); *B65H 5/224* (2013.01); *B65H 7/16* (2013.01); *G03G 15/6529* (2013.01); *B65H 2406/323* (2013.01)

(58) Field of Classification Search

CPC ..... G03G 15/00; G03G 15/6529; B65H 7/00; B65H 7/14; B65H 7/16; B65H 3/00; B65H 3/08; B65H 3/10; B65H 3/12; B65H 3/14; B65H 5/22; B65H 5/224; B65H 2406/323

See application file for complete search history.

(56) References Cited

U.S. PATENT DOCUMENTS

| | | | | |
|---|---|---|---|---|
| 8,265,498 | B2 * | 9/2012 | Fan | G03G 15/5029 399/389 |
| 9,096,399 | B2 * | 8/2015 | Umemoto | B65H 3/128 |
| 9,199,810 | B2 * | 12/2015 | Shimoyama | B65H 3/128 |
| 2011/0140345 | A1 * | 6/2011 | Suzuki | B65H 1/14 271/90 |

(Continued)

FOREIGN PATENT DOCUMENTS

| | | | |
|---|---|---|---|
| JP | 2005104723 | A | 4/2005 |
| JP | 2010254462 | A | 11/2010 |
| JP | 2012193065 | A | 10/2012 |

*Primary Examiner* — Nguyen Ha

(74) *Attorney, Agent, or Firm* — Holtz, Holtz & Volek PC

(57) ABSTRACT

A sheet feeder having: a base portion configured to support thereon a stack of sheets piled on top of another; a blower configured to blow air to the stack of sheets supported on the base portion so as to float one or more sheets in an uppermost portion of the stack of sheets; a suction/feed system located above the base portion, the suction/feed system configured to suck the sheet floated by the blower and to feed the sheet in a predetermined feeding direction; a photographic device configured to take a picture of the one or more sheets floated by the blower; and an illuminating device configured to emit light to the one or more sheets floated by the blower a plurality of times during one exposure process carried out by the photographic device.

9 Claims, 13 Drawing Sheets

(56) References Cited

U.S. PATENT DOCUMENTS

2011/0234675 A1* 9/2011 Korogi ..... B41J 11/0095 347/16
2013/0026696 A1* 1/2013 Matsumoto ..... B65H 3/128 271/5
2014/0061999 A1* 3/2014 Okamoto ..... B65H 3/08 271/11
2014/0265105 A1* 9/2014 Shimoyama ..... B65H 7/14 271/12
2015/0021848 A1* 1/2015 Mizuno ..... B65H 7/16 271/12

* cited by examiner

SHEET FEEDER AND IMAGE FORMING APPARATUS

This application claims benefit of priority to Japanese Patent Application No. 2014-179791 filed Sep. 4, 2014, the content of which is incorporated herein by reference.

BACKGROUND OF THE INVENTION

1. Field of the Invention

The present invention relates to a sheet feeder and an image forming apparatus, and more particularly to a sheet feeder configured to blow air to float a sheet from a stack of sheets, to pick up the sheet and to feed the sheet into a sheet path, and an image forming apparatus comprising the sheet feeder.

2. Description of Related Art

A sheet feeder disclosed in Japanese Patent Laid-Open Publication No. 2010-254462 is well known as an example of sheet feeders of an air-blowing type that blows air to float a sheet from a stack of sheets, picks up the sheet and feeds the sheet into a sheet path. In a conventional sheet feeder of this type, one or more sheets are floated by an air blower, and a picture of the topmost sheet and the second topmost sheet of the floated sheets is taken. Then, the distance between the topmost sheet and the second topmost sheet is determined, and the air volume blown from the air blower is controlled based on the determined distance.

In such a conventional sheet feeder, however, there is a risk of not perceiving the exact positions of the floated sheets. The sheets floated by the air blower move up and down repeatedly at a high speed, and the floated sheets cannot be always be photographed when they are at the highest positions. This causes a problem that, in some instances, what has been determined is not the distance between the topmost sheet and the second topmost sheet but the distance between two adjacent sheets at the middle level of the floated sheets.

SUMMARY OF THE INVENTION

An object of the present invention is to provide a sheet feeder that is capable of determining an exact position of a floated sheet and an image forming apparatus comprising the sheet feeder.

According to a first aspect of the present invention, a sheet feeder comprises: a base portion configured to support thereon a stack of sheets piled on top of another; a blower configured to blow air to the stack of sheets supported on the base portion so as to float one or more sheets in an uppermost portion of the stack of sheets; a suction/feed system located above the base portion, the suction/feed system configured to suck the sheet floated by the blower and to feed the sheet in a predetermined feeding direction; a photographic device configured to take a picture of the one or more sheets floated by the blower; and an illuminating device configured to emit light to the one or more sheets floated by the blower a plurality of times during one exposure process carried out by the photographic device.

According to a second aspect of the present invention, an image forming apparatus comprises the above-described sheet feeder.

DETAILED DESCRIPTION OF THE PREFERRED EMBODIMENTS

Figure 1:
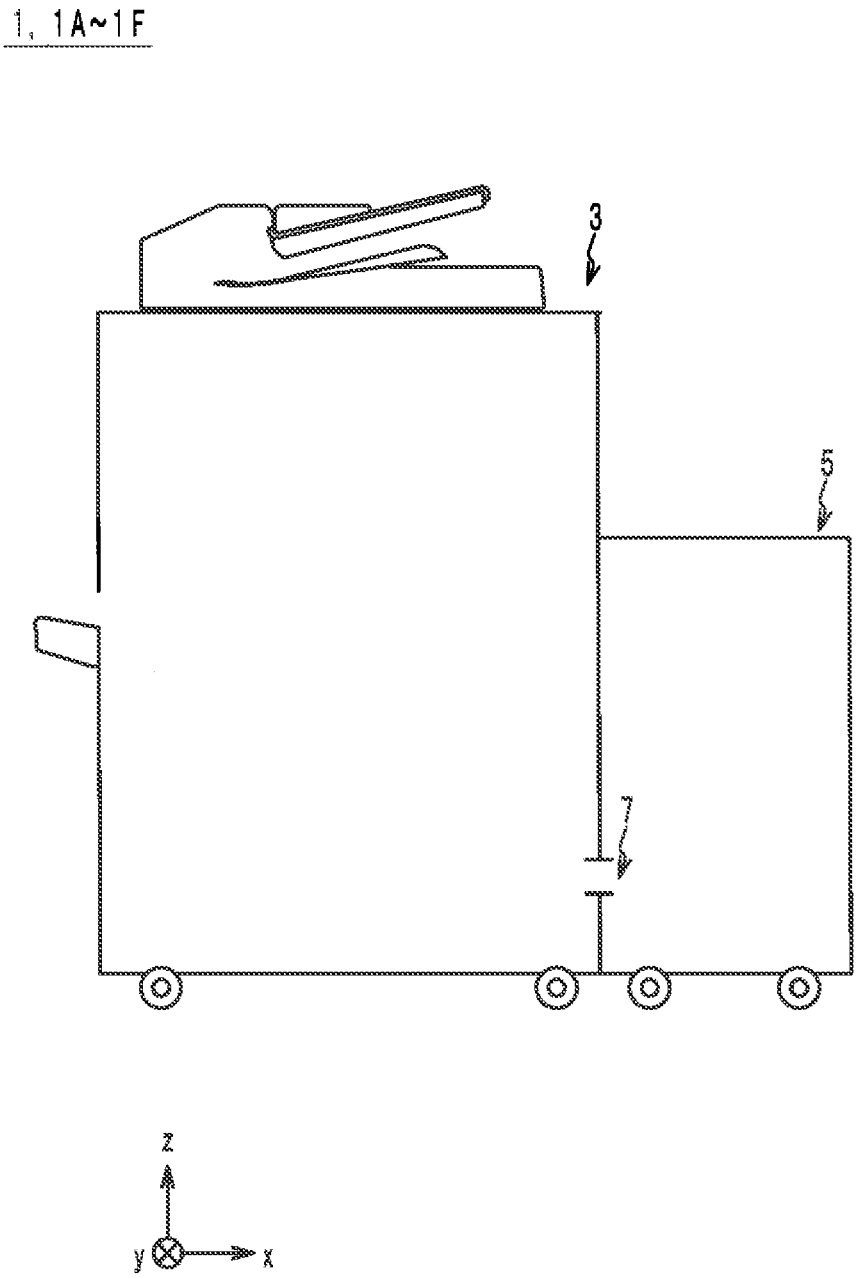
FIG. 1 is a schematic view of an image forming apparatus according to an embodiment of the present invention.

In the following, a sheet feeder according to an embodiment of the present invention and an image forming apparatus comprising the sheet feeder are described with reference to the drawings.

Preliminary Notice

In the following paragraphs, the x-axis, the y-axis and the z-axis are parallel to the horizontal (right-left) direction, the longitudinal (front-back) direction and the vertical (up-down) direction, respectively, of a sheet feeder and an image forming apparatus. In the drawings, some reference numerals are suffixed with a, b, c or d. The suffixes a, b, c and d mean yellow (Y), magenta (M), cyan (C) and black (Bk), respectively. For example, an image forming section 27*a* means an image forming section 27 for formation of a yellow image. Reference symbols with no suffixes denote members relating to the respective colors of Y, M, C and Bk. For example, image forming sections 27 mean image forming sections for formation of images in the respective colors Y, M, C and Bk.

Structure and Operation of Image Forming Apparatus

An image forming apparatus 1 according to an embodiment of the present invention, as illustrated in FIG. 1, comprises a main body 3 and a sheet feeder unit 5.

Figure 2:
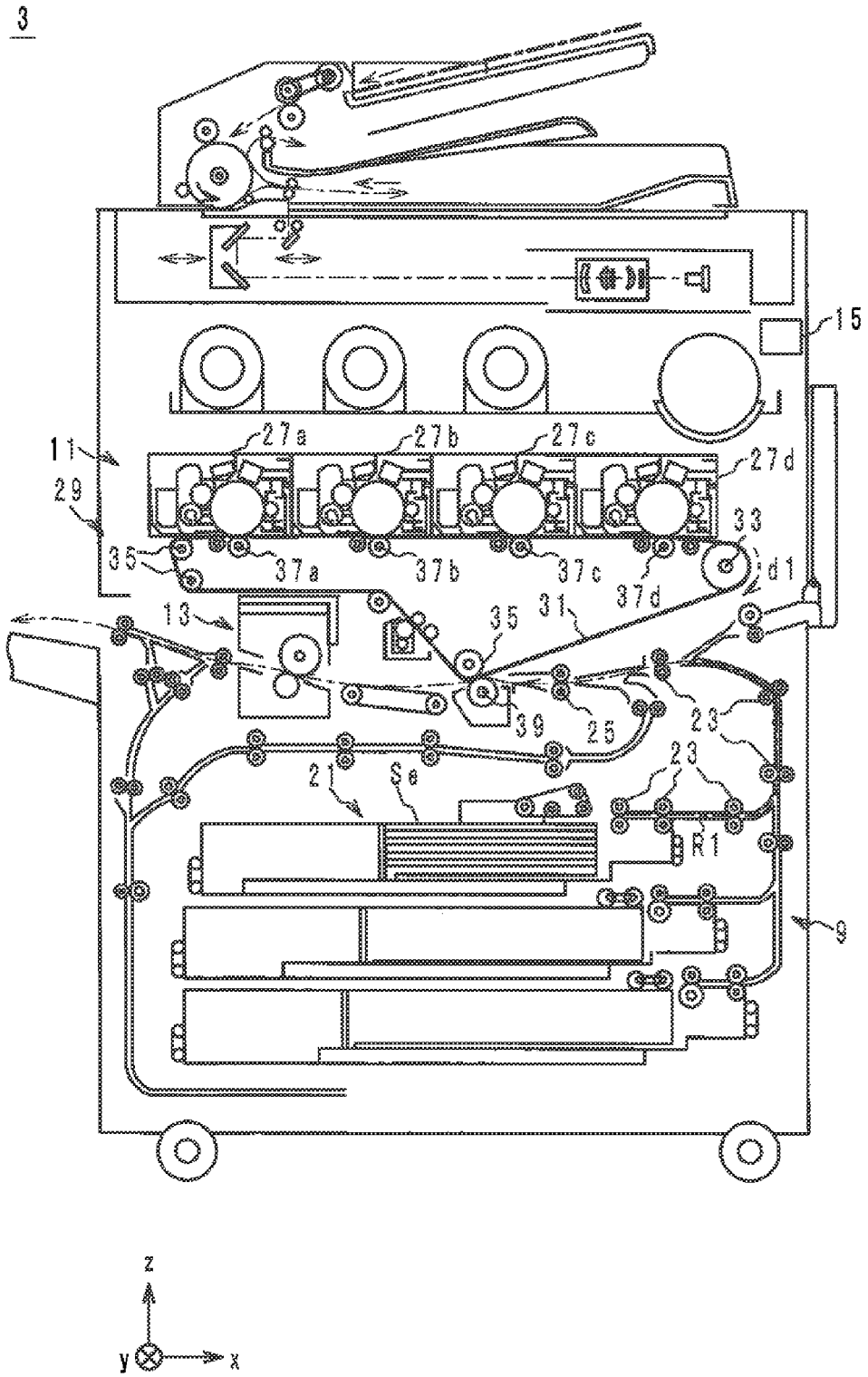
FIG. 2 is a schematic view illustrating the internal structure of a main body of the image forming apparatus according to the embodiment.

The main body 3 is, for example, an MFP (multifunction peripheral). As illustrated in FIG. 2, the main body 3 includes an internal sheet feeder unit 9, an image forming unit 11, a fixing unit 13 and a control circuit 15.

The internal sheet feeder unit 9 includes a sheet feeder 21, pairs of feed rollers 23 and a pair of resist rollers 25. In the sheet feeder 21, sheets (for example, sheets of paper) Se are stacked. The uppermost sheet of the sheet stack Se is picked up and fed into a first sheet path R1 indicated by alternate long and short dash line. The sheet is fed downstream in the sheet path by rotation of the pairs of feed rollers 23. Then, the sheet hits against the stopped pair of resist rollers 25, and the sheet is once stopped. The pair of resist rollers 25 is rotated under timing control of a CPU, and the sheet is fed from the pair of resist rollers 25 toward a second transfer area.

The image forming unit 11 forms images by an electrophotographic process. In this embodiment, the image forming unit 11 is a tandem type that is capable of forming full-color images. The image forming unit 11 includes image forming sections 27*a* through 27*d* and a transfer section 29.

The image forming sections 27 are to form images in different colors. Each of the image forming sections 27 includes a rotatable photoreceptor drum, and a charger, an exposure device and a developing device are provided around the photoreceptor drum.

Each charger charges the peripheral surface of the corresponding photoreceptor drum uniformly.

To each exposure device, image data of the corresponding color are input. Specifically, image data are sent to the CPU from a computer or any other device connected to the main body 3. The CPU generates image data of the colors Y, M, C and Bk from the image data sent thereto and sends the image data of the colors to the respectively corresponding exposure devices. Each of the exposure devices generates a light beam modulated in accordance with the image data sent thereto and scans the peripheral surface of the corresponding photoreceptor drum with the light beam line by line while the photoreceptor drum is rotating, thereby forming an electrostatic latent image of the corresponding color on the peripheral surface of the photoreceptor.

Each developing device develops the electrostatic latent image formed on the corresponding photoreceptor drum with toner, thereby forming a toner image in the corresponding color on the peripheral surface of the photoreceptor drum.

The transfer section 29 includes an endless intermediate transfer belt 31, a driving roller 33, driven rollers 35, first transfer rollers 37*a* through 37*d*, and a second transfer roller 39.

The intermediate transfer belt 31 is stretched over the driving roller 35 and the driven rollers 35. The driving roller 33 rotates under control of the CPU, and the driven rollers 35 rotate following the driving roller 33. Accordingly, the intermediate transfer belt 31 rotates in a direction indicated by arrow d1.

The first transfer rollers 37 are located to face the respectively corresponding photoreceptor drums across the intermediate transfer belt 31. By the effects of the first transfer rollers 37, the toner images carried on the photoreceptor drums are transferred to the same area of the intermediate transfer belt 31 sequentially, and a composite (overlaid) toner image is formed. The composite toner image is conveyed to the second transfer roller 39 by the rotation of the intermediate transfer belt 31.

The second transfer roller 39 is located to face one of the driven rollers 35 across the intermediate transfer belt 31. The second transfer roller 39 contacts with the intermediate transfer belt 31, thereby forming the second transfer area. The sheet fed from the pair of resist rollers 25 is introduced into the second transfer area. While the sheet is passing through the second transfer area, the composite toner image on the intermediate transfer belt 31 is transferred to the sheet (second transfer). After the second transfer, the sheet is fed from the second transfer area to the fixing unit 13.

The fixing unit 13 includes a fixing nip portion formed between a heating roller and a pressing roller. The sheet coming from the second transfer area is introduced into the fixing nip portion. The sheet is heated and pressed while passing through the fixing nip portion with rotation of the both rollers. Thereby, the composite toner image is fixed on the sheet. After the fixation, the sheet is fed from the fixing nip portion to a printed-sheet tray outside the main body.

The control circuit 15 includes at least a flash memory, a CPU and a main memory. The CPU controls the sheet feeder unit 5 and other units and members by performing a program, which is stored in the flash memory or any other memory, on the main memory.

Figure 3:
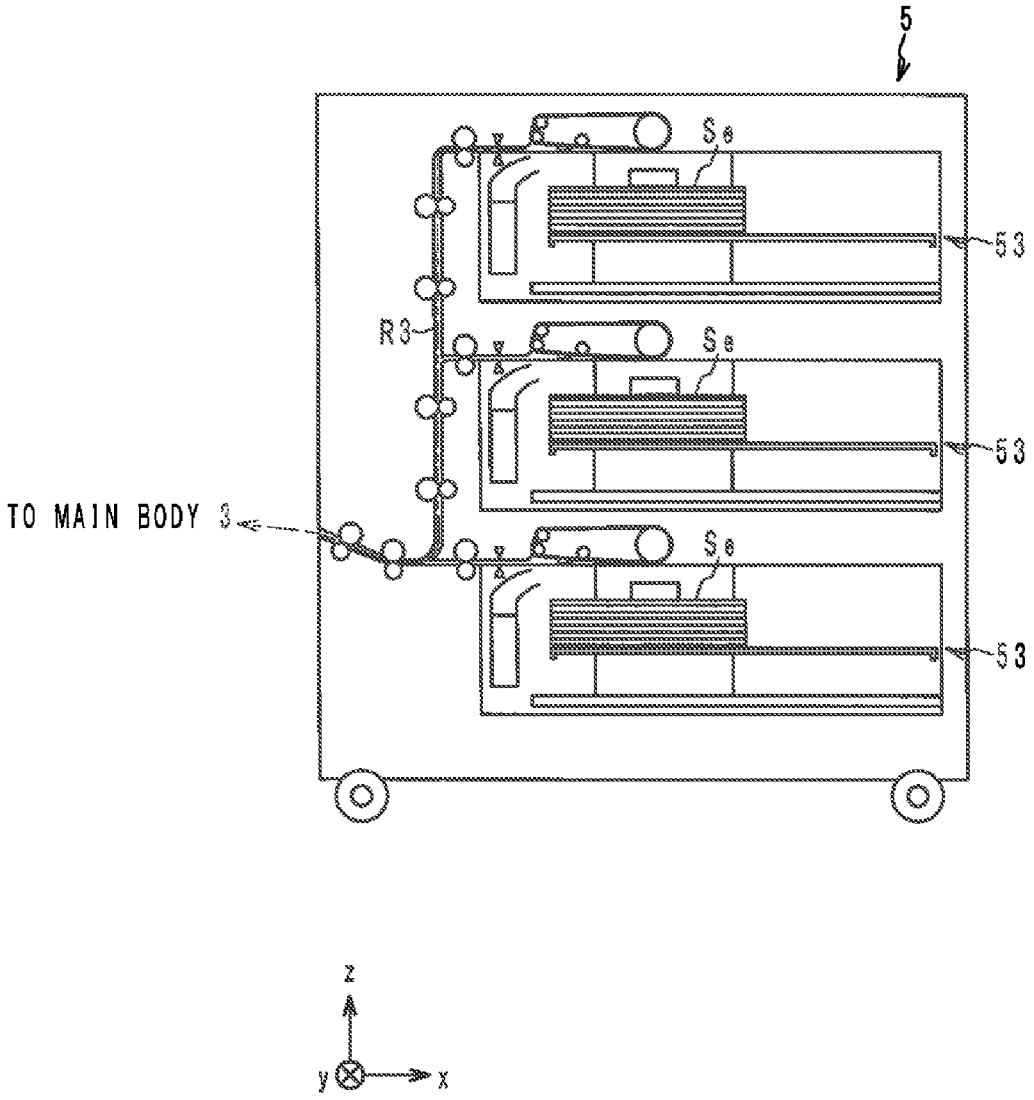
FIG. 3 is a schematic view illustrating the internal structure of a sheet feeder unit according to the embodiment.

As seen in FIG. 1, in the image forming apparatus 1, the sheet feeder unit 5 is located at the right side of the main body 3. The sheet feeder unit 5, as illustrated in FIG. 3, includes sheet feeders 53 arranged in tiers.

Each of the sheet feeders 53 has the same structure as the sheet feeder 21, and sheets (for example, sheets of paper) Se are stacked in each of the sheet feeders 53. Each of the sheet feeders 53 picks up the uppermost sheet of the sheet stack Se and feeds the uppermost sheet into a third sheet path R3 (indicated by alternate long and short dash line). After passing through the sheet path R3, the sheet is fed to the main body 3 via a communication hole 7 (see FIG. 1). In the main body 3, a sheet path (not illustrated in the drawings) for leading the sheet fed from the sheet feeders 53 to the pair of resist rollers 25 is provided.

Structure and Operation of Sheet Feeders; See FIGS. 4 and 5

The structure and the operation of the sheet feeders 53 are described. As mentioned above, the sheet feeder 21 has the same structure as the sheet feeders 53, and the sheet feeder 21 will not be described.

Figure 4:
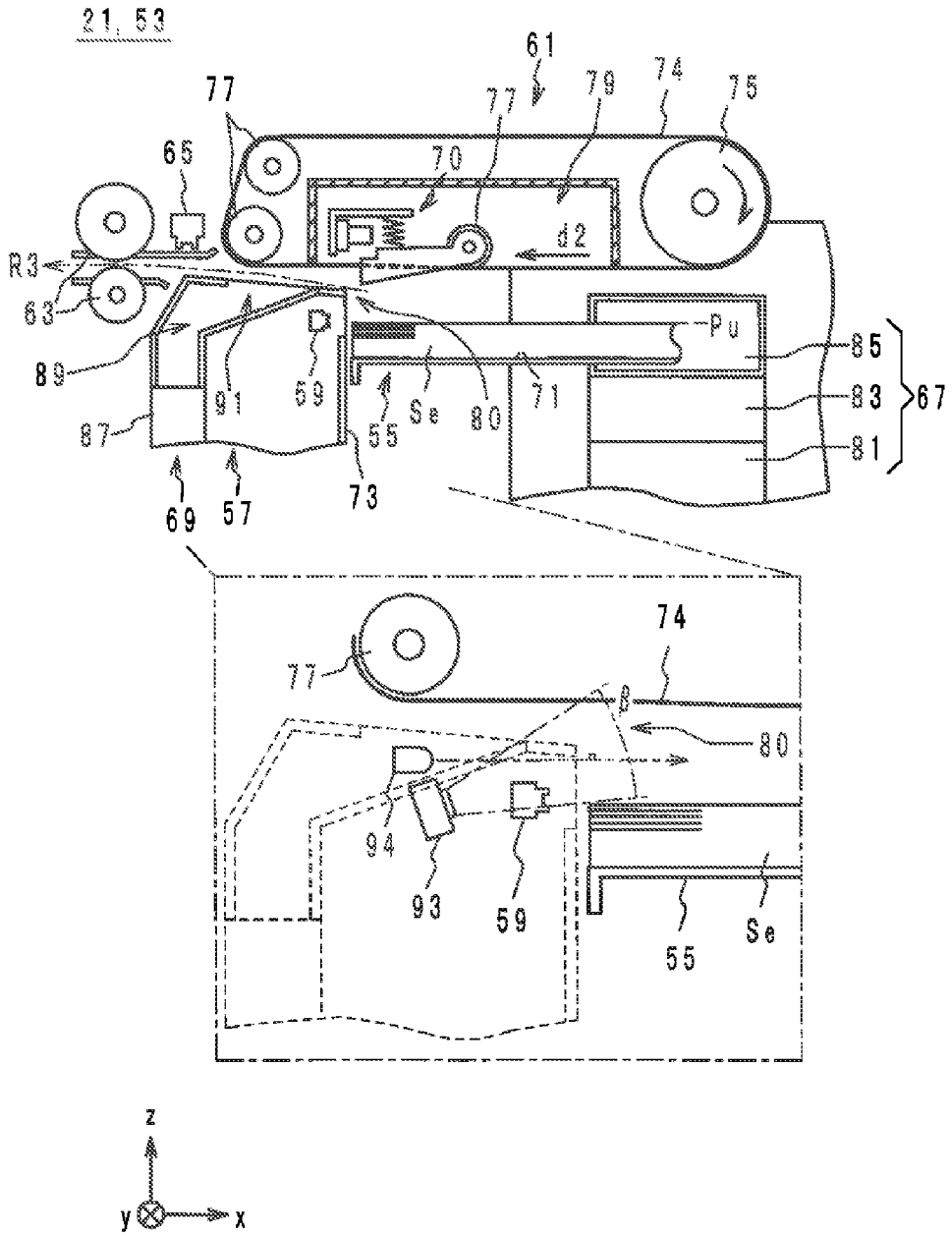
FIG. 4 is a schematic view illustrating the internal structure of a sheet feeder according to the embodiment.

The sheet feeders 53 are sheet feeders of an air-blowing type. As illustrated in FIG. 4, each of the sheet feeders 53 includes a base portion 55, a contact portion 57, an upper limit sensor 59, a suction/feed system 61, a pair of feed rollers 63, a sheet feed sensor 65, first air blowers 67, a second air blower 69, a suction sensor 70, a photographic device 93 and an illuminating device 94.

The base portion 55 includes a rectangular lifting plate 71 substantially parallel to the x-y plane. On the lifting plate 71, sheets Se are stacked in the z-direction. The base portion 55 is movable in the z-direction (that is, movable up and down) within a predetermined range.

The contact portion 57 includes a contact surface 73. The contact surface 73 is parallel to the z-direction and the y-direction, and is arranged along the negative side in x-direction of the lifting plate 71. The negative end in x-direction (that is, the left end) of the sheet stack Se contacts with the contact surface 73. Each of the sheets is fed to the third sheet path R3 with its negative end in x-direction as the leading edge.

The upper limit sensor 59, which is an optical active sensor, is fixed to the contact portion 57. The upper limit sensor 59 outputs an electric signal indicating whether the uppermost sheet of the sheet stack Se has reached a predetermined upper limit Pu to the control circuit 15.

The suction/feed system 61 is located above the base portion 55 and the contact portion 57. The suction/feed system 61 includes two suction belts 74, a chamber 79, a driving roller 75 and three driven rollers 77.

Figure 5:
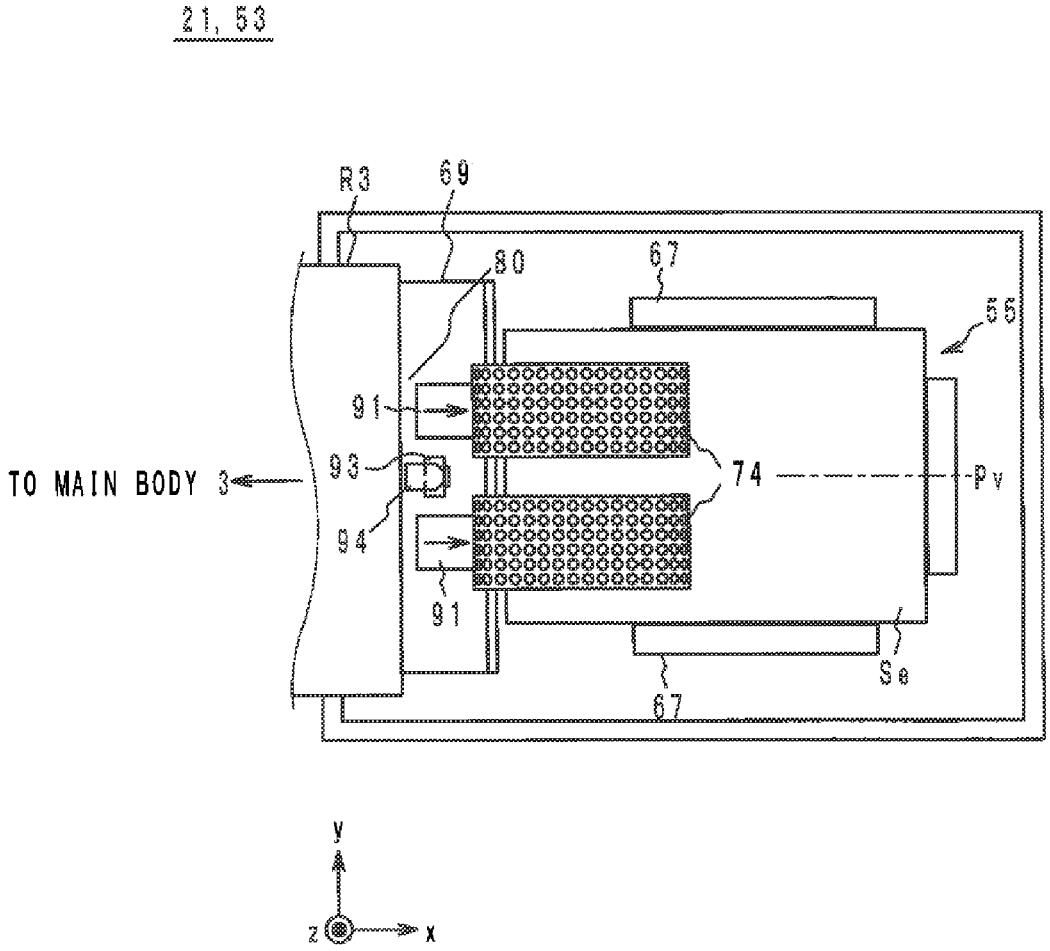
FIG. 5 is a schematic view illustrating the internal structure of the sheet feeder according to the embodiment.

The two suction belts 74 are arranged side by side in the y-direction. Each of the suction belts 74 is an endless belt, and a large number of through holes are pierced all over the belt from the outer peripheral surface to the inner peripheral surface. As indicated in FIG. 5, the large number of through holes are aligned in the widthwise direction and in the lengthwise direction of each of the belts 74.

As illustrated in FIG. 4, the chamber 79 is located inside the loops made by the respective suction belts 74, and in the chamber 79, an air inlet, a fan and a motor are provided. The air inlet is formed so as to face the lower inner surfaces of the suction belts 74. The fan is located in the chamber 79, and rotation of the fan permits the air above the sheet stack Se to be taken into the chamber 79 through the through holes of the suction belts 74. At this moment, the uppermost sheet of the sheet stack Se is floated by the first blowers 67 and other members and is sucked up to the lower outer surfaces of the suction belts 74. In the following, accordingly, the lower outer surfaces of the suction belts 74 may be referred to as suction surfaces.

The driving roller 75 is, for example, located above the substantial center of the sheet stack Se in the x-direction. Two of the driven rollers 77 are located above the second blower 69 to be arranged substantially one above the other. Between the lower driven roller 77 (which may be referred to as a left-end driven roller in the following) and the driving roller 75, the other driven roller 77 (which may be referred to as a middle driven roller) is located.

The two suction belts 74 are stretched over the rollers 75 and 77. Specifically, the driving roller 75 and the middle driven roller 77 are arranged such that the respective lower ends of the rollers 75 and 77 are substantially at the same position in the z-direction. The middle driven roller 77 and the left-end driven roller 77 are arranged such that the lower end of the left-end driven roller 77 is at a little higher position than the lower end of the middle driven roller 77. Accordingly, between the driving roller 75 and the middle driven roller 77, each of the suction belts 74 is substantially parallel to the x-y plane, and from the middle driven roller 77 to the left-end driven roller 77, each of the suction belts 74 is slightly inclined upward from the x-y plane. Thus, each of the suction belts 74 curves at the middle transfer roller 77. The suction belts 74 stretched in this manner rotate in a direction of arrow d2 following rotation of the driving roller 75. Therefore, the uppermost sheet sucked to the suction surfaces of the suction belts 74 is fed in the negative x-direction (sheet feeding direction).

The third sheet path R3 includes guide members. As illustrated in FIGS. 4 and 5, the beginning portion of the third sheet path R3 is an entrance 80 for a sheet. This entrance 80 is a space above the upper surface of the contact portion 57 and below the left-end driven roller 77.

The pair of feed rollers 63 is located on the third sheet path R3, near the entrance 80. The pair of feed rollers 63 rotates under control of the CPU to feed a sheet introduced thereto through the entrance 80 downstream along the third sheet path R3.

The sheet feed sensor 65, which is an optical active sensor, is located on the third sheet path R3, between the entrance 80 and the pair of feed rollers 63. When a sheet passes a reference position between the entrance 80 and the pair of feed rollers 63, the sheet feed sensor 65 outputs an electric signal indicating the state to the control circuit 15.

As illustrated in FIG. 5, the first blowers 67 are located in front of and behind the base portion 55, respectively. Each of the first blowers 67, as illustrated in FIG. 4, includes a fan 81, a duct 83 and an air outlet 85.

Each fan 81 is configured to take the surrounding air into the duct 83. The air outlet 85 is formed at the upper side of the duct 83 so as to face the upper portion of the sheet stack Se. In the front-side first blower 67, the air taken into the duct 83 flows in the duct 83 to the air outlet 85, and the air ejected from the air outlet 85 blows the front side of the upper portion of the sheet stack Se.

The back-side first blower 67 is arranged substantially symmetrical to the front-side first blower 67 with respect to the center plane Pv in y-direction of the lifting plate 71 (see FIG. 5). Accordingly, the air ejected from the back-side air outlet 85 blows the back side of the upper portion of the sheet stack Se.

As described above, the air ejected from the front-side and the back-side air outlets blows the front side and the back side of the upper portion of the sheet stack Se. The air mainly serves to float one or more sheets in the upper portion of the sheet stack Se.

The second blower 69 is located at the negative side in x-direction of the contact portion 57 so as to prevent simultaneous feeding of two or more sheets. Specifically, when the suction belts 74 suck two or more sheets at one time, the second blower 69 separates the second and the following sheets from the first sheet. The second blower 69, as illustrated in FIG. 4, basically includes a fan 87 and a duct 89. The fan 87 is located in the lower portion of the second blower 69, and the duct 89 is located in the upper portion of the second blower 69.

The fan 87 takes the surrounding air into the duct 89. The air taken into the duct 89 is ejected therefrom through outlets 91 made in the upper surface of the duct 89 and blows the entrance 80 of the third sheet path R3. In this embodiment, two outlets 91 are formed as seen in FIG. 5. The air ejected through one of the air outlets 91 comes to a space underneath the front-side suction belt 74, and the air ejected through the other air outlet 91 comes to a space underneath the back-side suction belt 74. The sheets that are floating while adhering to each other are separated by the air.

The suction sensor 70 includes at least an optical active sensor and an analyzer, and the suction sensor 70 is located in the chamber 70 as seen in FIG. 4. When the suction belts 74 suck a sheet, the suction sensor 70 outputs an electric signal indicating the state to the control circuit 15.

The photographic device 93 takes a picture of the one or more sheets floated by the first blowers 67. In this embodiment, in consideration of the airflow (see the arrows) from the two air outlets 91, as seen in FIG. 5, the photographic device 93 is located between the two air outlets 91 in a plan view from the z-direction.

More specifically, the photographic device 93 is arranged to have a clear view of a space 6 (see the illustration inside the frame of alternate long and short dash line in FIG. 4) between the suction belts 74 and the leading edge of the uppermost sheet of the sheet stack Se. The meaning of the photographic device 93 having "a clear view of a space β" is that there are no obstructions that block the view from a lens of the photographic device 93 to the space 6. Image data taken by the photographic device 93 are sent to the control circuit 15.

The illuminating device 94 is an LED (light emitting diode) in this embodiment, and as seen in FIG. 5, the illuminating device 94 is located at a position not to block the airflow from the air outlets 91. The illuminating device 94 emits light a plurality of times during one exposure process carried out by the photographic device 93, that is, during one-frame photographing. The one or more sheets floated by the first blowers 67 are illuminated with the light emitted from the illuminating device 94. In this embodiment, the illuminating device 94 emits light three times during one exposure process carried out by the photographic device 93.

Control of Sheet Feeders; See FIGS. 6 and 7

Figure 6:
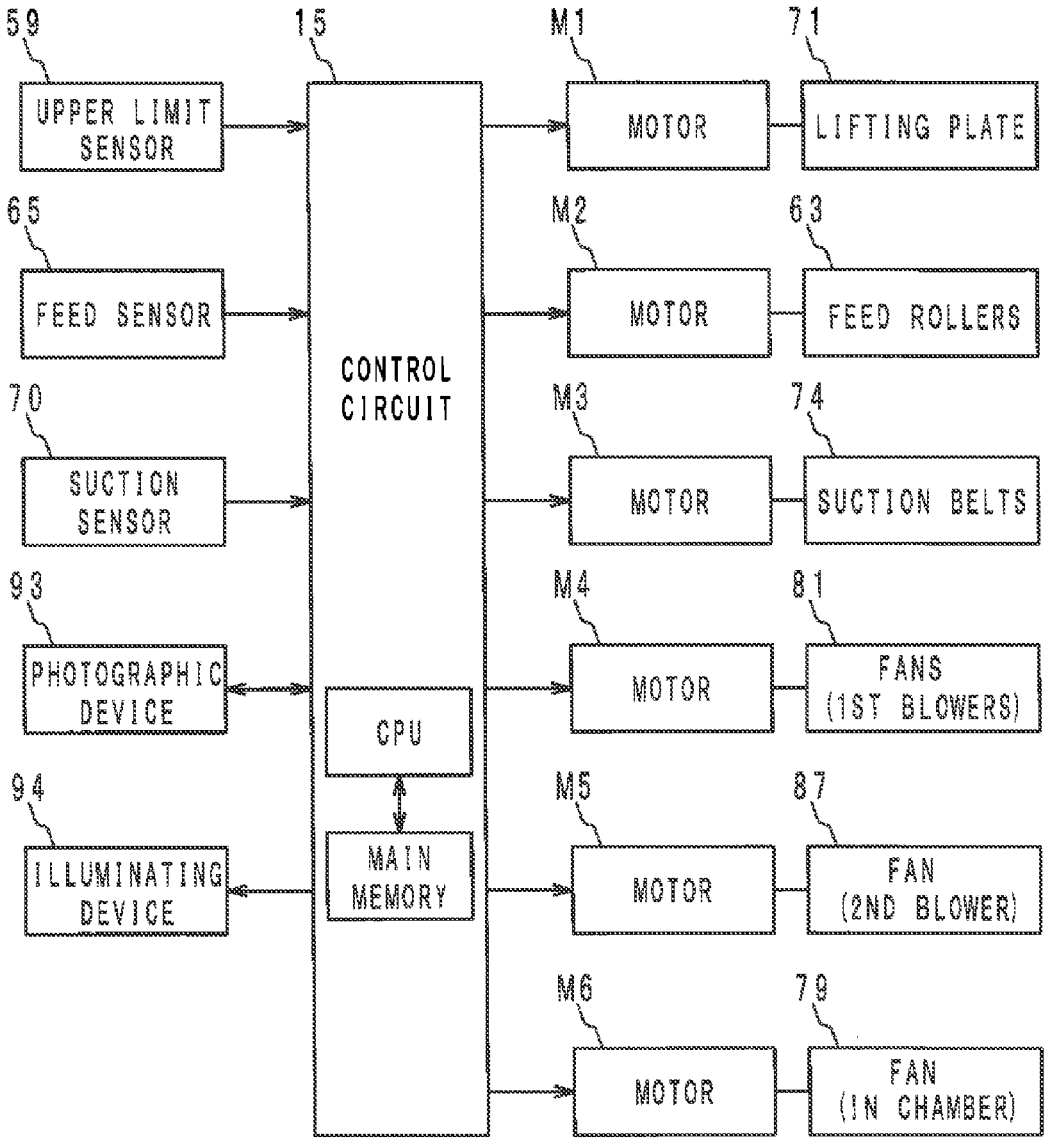
FIG. 6 is a block diagram indicating the relation between a control circuit and each part.

The sheet feeders 21 and 53 are controlled by the control circuit 15. With respect to each of the sheet feeders 21 and 53, as illustrated in FIG. 6, the control circuit 15 receives electric signals from the upper limit sensor 59, the sheet feed sensor 65 and the suction sensor 70 provided in each of the sheet feeders 21 and 53, and receives image data taken by the photographic device 93 provided in each of the sheet feeders 21 and 53. From the electric signals and the image data, the control circuit 15 perceives the state of sheet feeding.

Also, in accordance with the electric signals and the image data, the control circuit 15 controls a drive motor M1 for the lifting plate 71, a drive motor M2 for the pair of feed rollers 63, a drive motor M3 for the suction belts 74, a drive motor M4 for the fans 81 of the first blowers 67, a drive motor M5 for the fan 87 of the second blower 69, and a drive motor M6 for the fan located in the chamber 79. A detailed description will be given below.

First, when a print command is issued by an input from the user, the control circuit 15 starts the sheet feeders 21 and 53.

Figure 7:
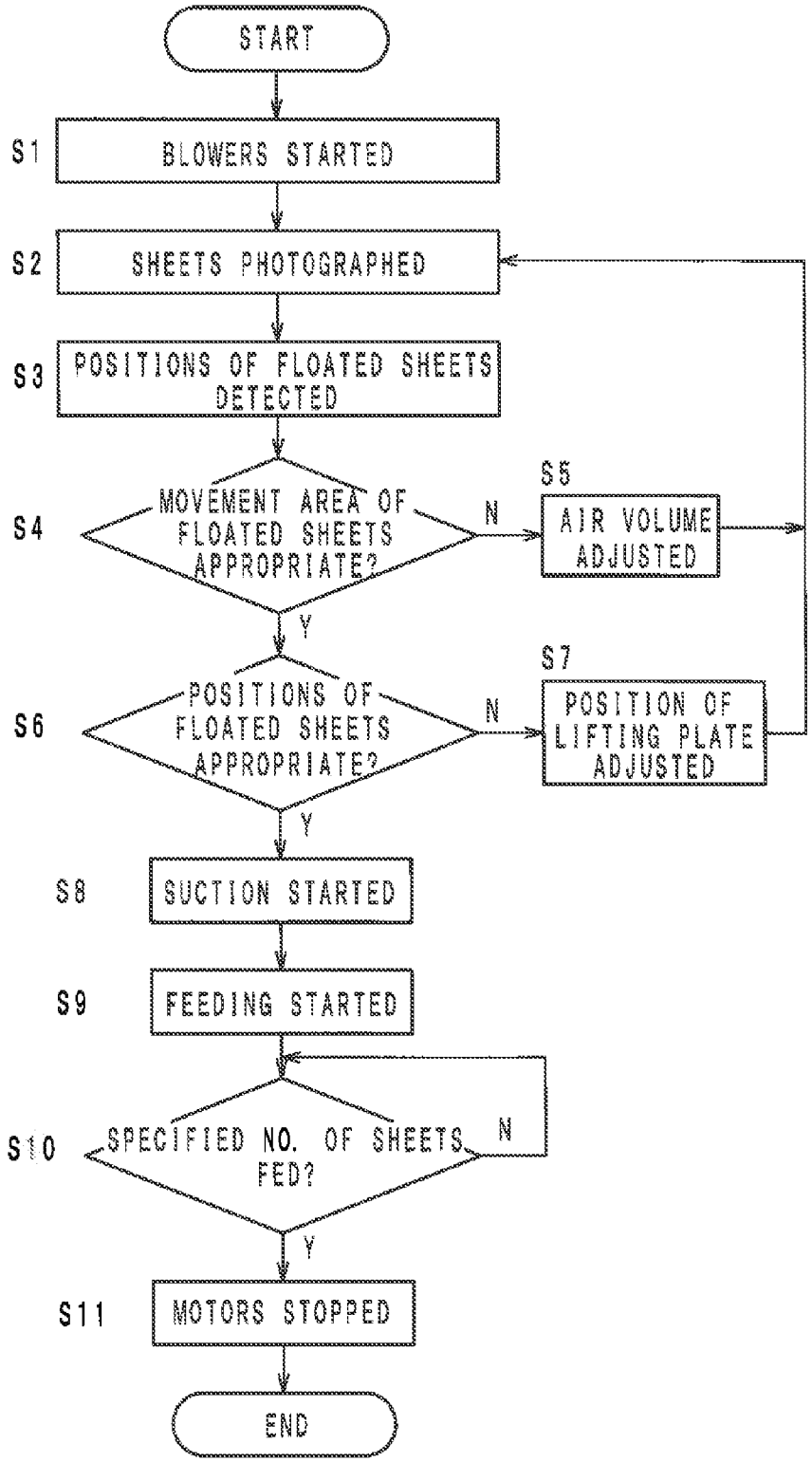
FIG. 7 is a flowchart indicating a procedure for controlling the sheet feeder.

As illustrated in FIG. 7, at step S1 of a procedure for controlling the sheet feeders 21 and 53, the control circuit 15 activates the drive motor M4 such that the first blowers 67 start blowing air. Thereby, one or more sheets in the upper portion of the sheet stack Se are floated. Simultaneously, the control circuit 15 activates the drive motor M5 such that the second blower 69 starts blowing air. In this moment, the air volume from the first blowers 67 and the air volume from the second blower 69 are determined based on initial values preliminary stored in the flash memory or the like of the control circuit 15.

Figure 8:
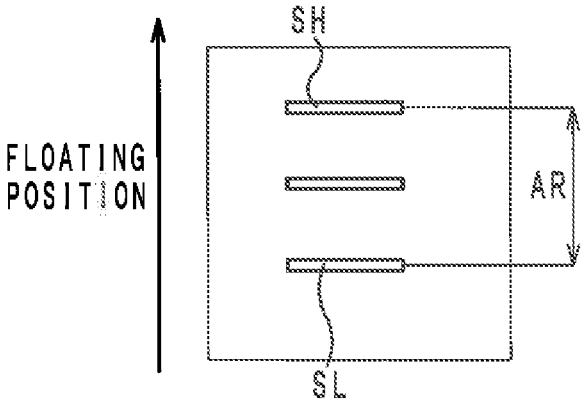
FIG. 8 is a pattern diagram of a picture of floated sheets.
Figure 9:
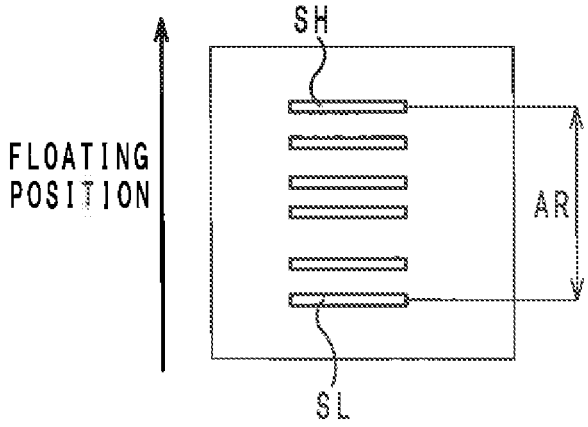
FIG. 9 is a pattern diagram of a picture of floated sheets.

At step S2, the control circuit 15 activates the photographic device 93 to take a picture of the floated one or more sheets. In this moment, the illuminating device 94 emits light toward the floated sheet(s) three times at uniform intervals during one-frame photographing. Therefore, in a picture taken in this way, three images of each floated sheet at three different points of time are seen. In this embodiment, for example, let the frame rate of the photographic device 93 be 0.03 seconds and the intervals between the light emissions from the illuminating device 94 be 0.01 seconds. In a case where only one sheet is floated, as illustrated in FIG. 8, three images of the sheet are seen in one picture, at positions where the sheet was at every 0.01 seconds. If two sheets are floated, as illustrated in FIG. 9, a total of six images of the two sheets are seen in one picture.

At step S3, the control circuit 15 detects the position of the highest image SH of a sheet and the position of the lowest image SL of a sheet in one picture.

At step S4, the control circuit 15 derives, from the positions of the images SH and SL detected at step S3, an up-and-down movement area AR within which the floated one or more sheets move up and down, and the control circuit 15 determines whether the up-and-down movement area AR is appropriate. If the up-and-down movement area AR is not appropriate, the control procedure goes to step S5, and if the up-and-down movement area AR is appropriate, the control procedure goes to step S6.

At step S5, in order to make the up-and-down movement area AR appropriate, the control circuit 15 adjusts the air volume from the first blowers 67. Specifically, if the up-and-down movement area AR is broader than an appropriate range, the output of the drive motor M4 is decreased. After the air volume adjustment, the control procedure returns to step S2. It is preferred that the up-and-down movement area AR is narrow. The minimum air volume from the first blowers 67 is determined to be a minimum necessary air volume for flotation of a sheet.

At step S6, the control circuit 15 determines whether the positions of the one or more floated sheets are appropriate. If the positions of the floated sheets are not appropriate, the control procedure goes to step S7, and if the positions of the floated sheets are appropriate, the control procedure goes to step S8.

At step S7, in order to float the sheets to appropriate positions, the position of the lifting plate 71 is changed. Specifically, the output of the drive motor M1 for the lifting plate 71 is adjusted. For example, if the positions of the floated sheets are higher than the appropriate positions, the drive motor M1 is activated to rotate in a direction to lower the lifting plate 71. On the other hand, if the positions of the floated sheets are lower than the appropriate positions, the drive motor M1 is activated to rotate in a direction to raise the lifting plate 71. After the change of the position of the lifting plate 71, the control procedure returns to step S2.

At step S8, the control circuit 15 activates the drive motor M6 for the fan located in the chamber 79. Thereby, the uppermost sheet is sucked by the suction belts 74. When the suction sensor 70 detects the uppermost sheet sucked by the suction belts 74, the suction sensor 70 outputs an electric signal indicating the state to the control signal 15. The control circuit 15 receives the signal from the suction sensor 70, and the control procedure goes to step S9.

At step S9, the control circuit 15 activates the drive motor M2 for the pair of feed rollers 63 and the drive motor M3 for the suction belts 74. Thereby, the sheet sucked by the suction belts 74 is fed to the third sheet path R3. Then, the sheet feed sensor 65 detects the sheet fed into the third sheet path R3, and the sheet feed sensor 65 outputs an electric signal indicating the state to the control circuit 15. Thereafter, the control procedure goes to step S10.

At step S10, the control circuit 15 counts the number of sheets fed from the sheet feeder 53 based on the signals sent from the feed sensor 65. When the count number becomes equal to the number of prints to be made that was sent to the control circuit 15 together with the print command, the control procedure goes to step S11. Until the count number reaches the number of prints to be made, the control circuit 15 stands by at step S10.

At step S11, the control circuit 15 stops the drive motor M1 for the lifting plate 71, the drive motor M2 for the pair of feed rollers 63, the drive motor M3 for the suction belts 74, the drive motor M4 for the fan 81, the drive motor M5 for the fan 87, and the drive motor M6 for the fan located in the chamber 79. The control procedure ends with this step.

Advantageous Effects

In each of the sheet feeders 21 and 53 of the image forming apparatus 1 according to the first embodiment, during one exposure process carried out by the photographic device 93, that is, during one-frame photographing, one or more sheets floated by the first blowers 67 are illuminated with light emitted from the illuminating device 94 three times. Thereby, the states of the sheets at three different points of time are seen in one picture. Hence, even with a camera having a low frame rate compared with the speed of the up-and-down movements of the sheets, it is possible to perceive the movements of the sheets during one-frame photographing. Accordingly, the image forming apparatus 1 according to the first embodiment and the sheet feeders 21 and 53 provided therein are capable of detecting the positions of one or more sheets floated by the blowers more accurately, compared with a conventional sheet feeder that detects the positions of one or more sheets floated by a blower only at one point of time during one-frame photographing. This will be described below in more detail with reference to FIG. 19.

Figure 19:
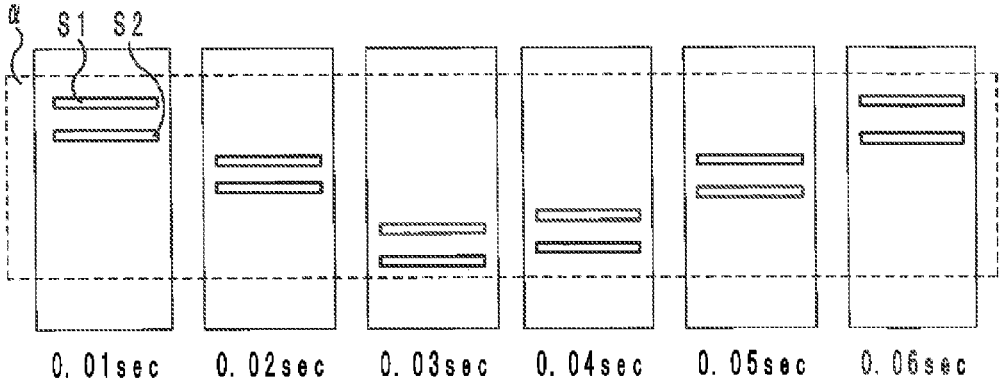
FIG. 19 is a pattern diagram illustrating movements of floated sheets.

FIG. 19 illustrates a case where two sheets S1 and S2 are floated in the air, and in FIG. 19, the floating positions of the sheets S1 and S2 at every 0.01 second are shown. In FIG. 19, the vertical direction indicates the floating direction of the sheets, and the sheets move from the state indicated by the leftmost view to right sequentially as time proceeds. In FIG. 19, a denotes an area within which the sheets floated by air blowing should move. As seen in FIG. 19, the sheets floated by the blowers move up and down repeatedly at a high speed. Accordingly, there has been a problem that accurate detection of the positions of the floated sheets with a commonly-used camera is difficult because such a commonly-used camera has a low frame rate compared with the speed of the up-and-down movements of the sheets. In the sheet feeders 21 and 53, however, for a period of 0.03 seconds, which is a period for one-frame photographing, the illuminating device 94 emits light three times at intervals of 0.01 second. Thereby, images of the sheets at three different points of time during one-frame photographing are seen in one picture. Thus, even with a camera having a low frame rate compared with the speed of the up-and-down movements of sheets, it is possible to perceive the movements of the sheets during one-frame photographing.

First Modification; See FIG. 10

An image forming apparatus 1A according to a first modification is different from the image forming apparatus 1 according to the first embodiment in the step S3 of the procedure for controlling the sheet feeders 21 and 53.

According to the first modification, at step S3, not only the positions of the highest image and the lowest image of one or more floated sheets but also the positions of the uppermost floated sheet P1 and the positions of the second uppermost floated sheet P2 are detected.

Figure 10:
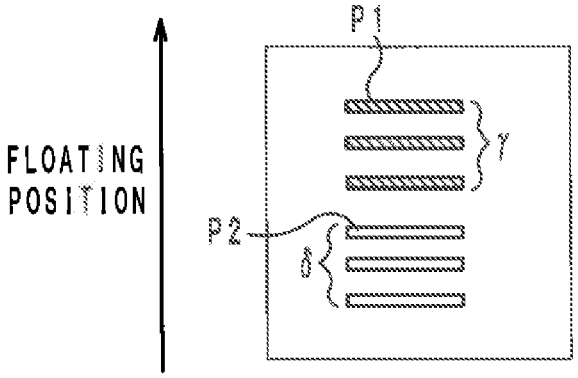
FIG. 10 is a pattern diagram of a picture of floated sheets.

For example, a case as illustrated by FIG. 10 where two sheets P1 and P2 are floated is considered. The range within which the uppermost floated sheet P1 moves up and down is denoted by γ, and the range within which the second uppermost floated sheet P2 moves up and down is denoted by δ. The ranges γ and δ do not overlap with each other. In this case, a total of six images of the sheets are seen in one picture. At step S3 according to the first modification, the three images from the topmost to the third topmost in the picture are determined to be images of the sheet P1, and the three images from the fourth topmost to the sixth topmost are determined to be images of the sheet P2.

In this way, at step S3 according to the first modification, the positions of the uppermost floated sheet P1 and the positions of the second uppermost floated sheet P2 are detected. This leads to prevention of flotation of the sheet P2 to too high a position, thereby resulting in prevention of a problem that the sheet P2 is sucked by the suction belts 74 and fed to the third feed path R3 together with the sheet P1.

Second Modification; See FIG. 11

An image forming apparatus 1B according to a second modification is different from the image forming apparatus 1A according to the first modification in the step S3 of the procedure for controlling the sheet feeders 21 and 53. Specifically, at step S3 according to the second modification, even in a case where the range γ within which the uppermost floated sheet P1 moves up and down and the range δ within which the second uppermost floated sheet P2 moves up and down overlap with each other, the positions of the uppermost floated sheet P1 and the positions of the second uppermost floated sheet P2 are detected. A detailed description will be given below.

Figure 11:
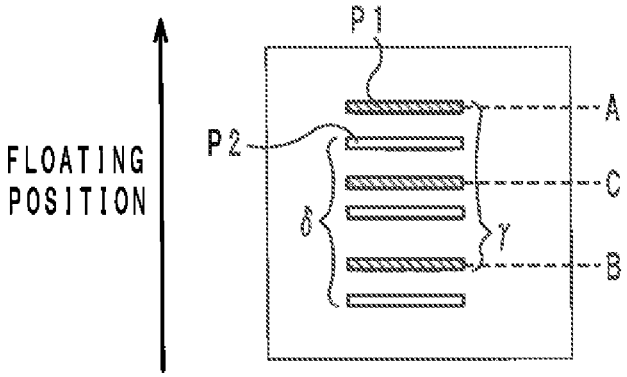
FIG. 11 is a pattern diagram of a picture of floated sheets.

For example, a case as illustrated by FIG. 11 where two sheets are floated such that the range γ within which the uppermost floated sheet P1 moves up and down and the range δ within which the second uppermost floated sheet P2 moves up and down overlap with each other is considered. In this case, a total of six images of the sheets are seen in one picture. The control circuit 15 determines the image at the highest position A to be an image of the sheet P1.

Next, the control circuit 15 finds out which two of the other five images are images of the sheet P1. To this end, the control circuit 15 first determines the amplitude of the up-and-down movement of the floated sheet P1 at the current air volume from the first blowers 67. More specifically, a table indicating the relation between the air volume from the first blowers 67 and the amplitude of the up-and-down movement of the sheet P1 is stored in the flash memory or the like, and the control unit 15 selects one of the amplitudes from the table as the amplitude of the up-and-down movement of the floated sheet P1 at the current air volume. Then, the control circuit 15 specifies the lowest position of the floated sheet P1 based on the position A and the amplitude of the up-and-down movement of the sheet P1. In this way, the control circuit 15 finds out which one of the five images is an image of the floated sheet P1 at the lowest position B.

Next, the control circuit 15 determines which of the images between the position A and the position B is an image of the sheet P1. In this regard, a table indicating the relation between the air volume from the first blowers 67 and the frequency of the up-and-down movement of the sheet P1 is stored in the flash memory or the like, and the control circuit 15 selects one of the frequencies from the table as the frequency of the up-and-down movement of the sheet P1 at the current air volume. Then, from the previously-determined amplitude and the currently-determined frequency, the control circuit 15 figures out the moving speed of the sheet P1. Further, based on the moving speed of the sheet P1 and the time interval between light emissions from the illuminating device 94, the control circuit 15 determines which of the images between the position A and the position B is an image of the sheet P1. In this way, the control circuit 15 determines which three of the six images seen in the picture are images of the sheet P1.

Thereafter, the control circuit 15 determines which three of the six images are images of the sheet P2 by eliminating the images of the sheet P1.

In a case where three or more sheets are floated, after eliminating the images of the sheet P1 from the images seen in the picture, the control circuit 15 determines the uppermost one of the remaining images is determined to be an image of the sheet P2. Then, the images of the sheet P2 at other positions are determined in the same manner as done to determine the images of the sheet P1. Further, the images of the sheet P2 are eliminated from the images seen in the picture, and the uppermost one of the remaining images is determined to be an image of a sheet P3. In this way, the control circuit 15 determines sequentially which images are images of each sheet.

As described above, in the image forming apparatus 1B according to the second modification, at step S3 of the procedure for controlling the sheet feeders 21 and 53, even in a case where the range γ within which the uppermost floated sheet P1 moves up and down and the range δ within which the second uppermost floated sheet P2 moves up and down overlap with each other, the positions of the uppermost floated sheet P1 and the positions of the second uppermost floated sheet P2 can be detected.

Third Modification; See FIG. 12

An image forming apparatus 1C according to a third modification is different from the image forming apparatus 1 according to the first embodiment mainly in the way of illuminating one or more floated sheets with the illuminating device 94.

Figure 12:
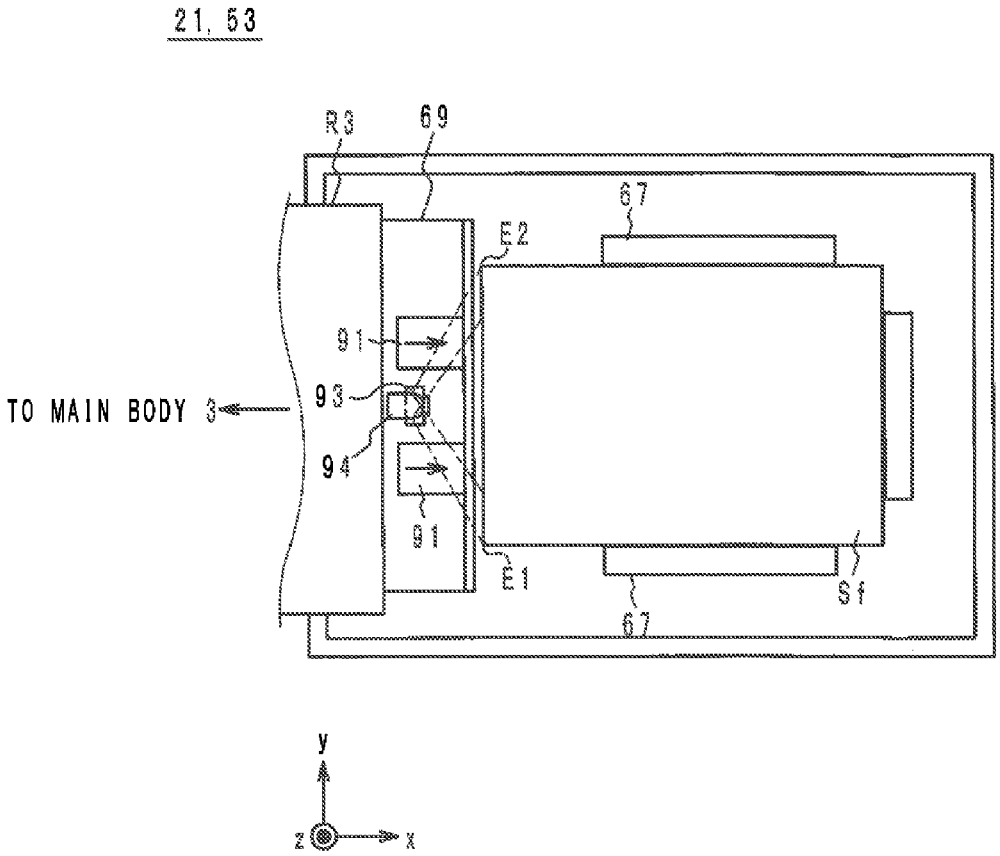
FIG. 12 is a schematic view of a sheet feeder according to a third modification, illustrating the internal structure thereof with the suction/feed system omitted.

According to the third modification, when one or more floated sheets are illuminated with the illuminating device 94, the illuminating device 94 emits light to different sides of the sheets as illustrated in FIG. 12. For example, during one-frame photographing by the photographic device 93, the illuminating device 94 makes a first light emission toward a first side portion E1 of the floated sheets Sf and makes a second light emission toward a second side portion E2 of the floated sheets Sf. Further, the illuminating device 94 makes a third light emission toward the first side portion E1 of the floated sheets Sf again.

Figure 13:
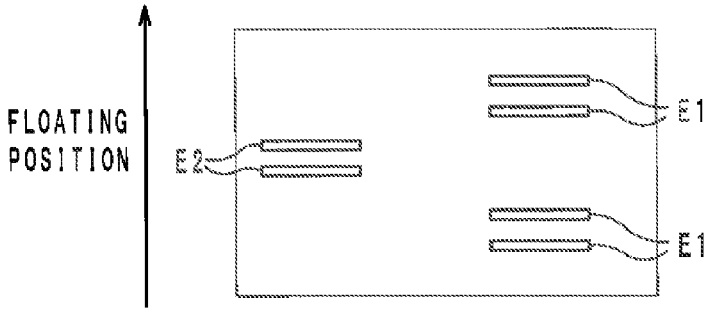
FIG. 13 is a pattern diagram of a picture of floated sheets taken by a photographic device of the sheet feeder according to the third modification.

In this way, the illuminating device 94 according to the third modification emits light toward different portions of one or more floated sheets during one-frame photographing by the photographic device 93. This makes it easy to know the number of floated sheets. Specifically, according to the third modification, only the second light emission from the illuminating device 94 is directed to the second side E2 of the floated sheets. Therefore, in the side portion E2 of the picture, as illustrated in FIG. 13, only images of the sheets taken at the time of the second light emission are seen. From the images seen in the side portion E2 of the picture, the number of floated sheets becomes clear. In the case of FIG. 13, it is clear from the images seen in the side portion E2 that two sheets are floated.

After perceiving the number of floated sheets, the positions of each of the floated sheets are figured out from the images seen in the side portion E1 of the picture in consideration of the moving speed of the sheets, the time interval between light emissions from the illuminating device 94, etc. in the same manner as in the second modification.

Fourth Modification

An image forming apparatus 1D according to a fourth modification is different from the image forming apparatus 1C according to the third modification mainly in the structure of the illuminating device 94.

Figure 14:
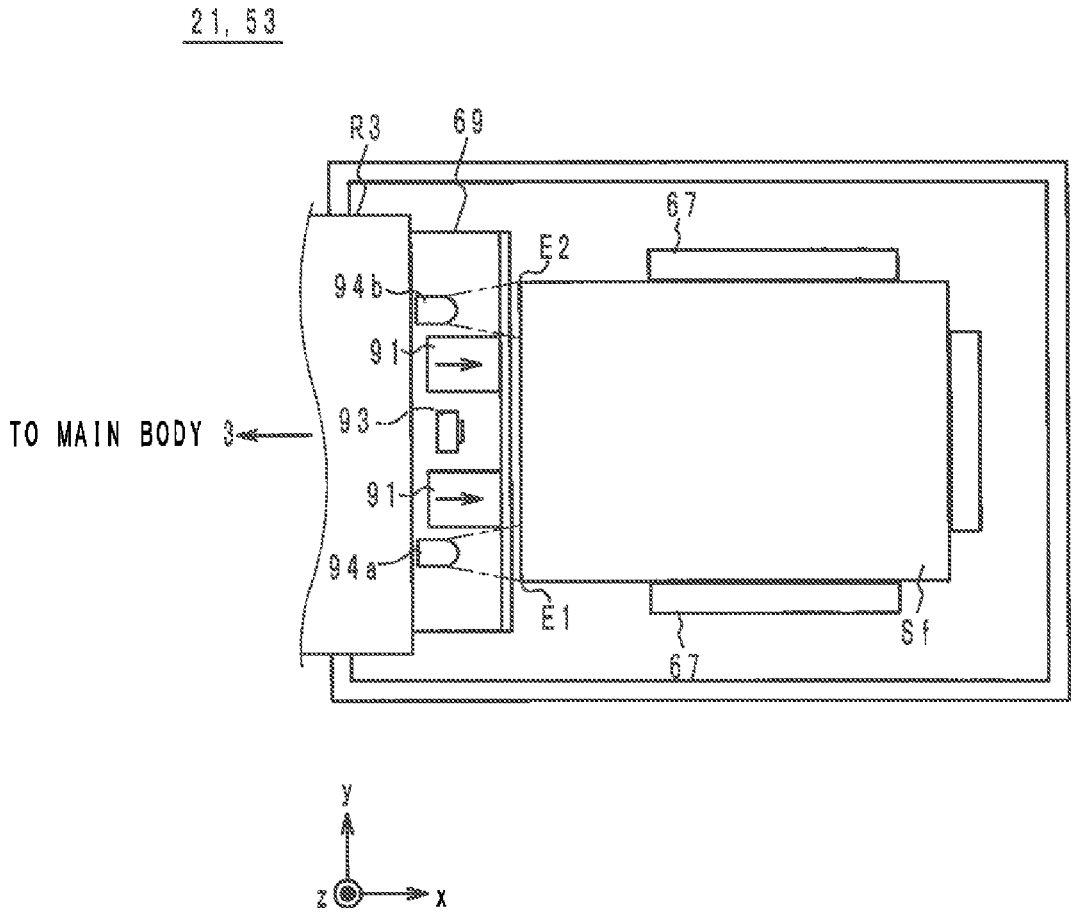
FIG. 14 is a schematic view of a sheet feeder according to a fourth modification, illustrating the internal structure thereof with the suction/feed system omitted.
Figure 15:
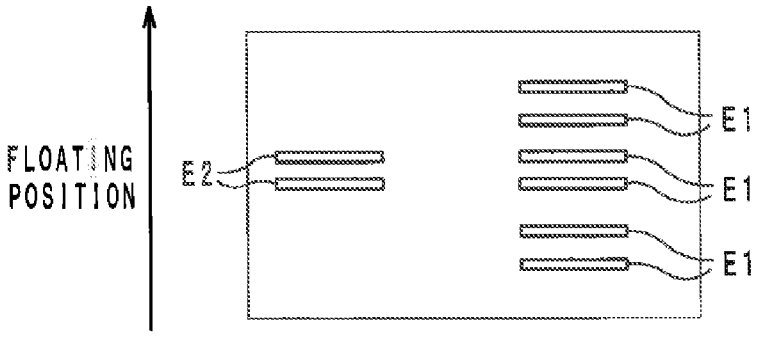
FIG. 15 is a pattern diagram of a picture of floated sheets taken by a photographic device of the sheet feeder according to the fourth modification.

According to the fourth modification, the illuminating device 94 includes two light sources 94*a* and 94*b* aligned in the lateral direction of the sheets as illustrated in FIG. 14. According to the fourth modification, during one-frame photographing by the photographic device 93, the illuminating device 94 emits light from the light source 94*a* three times toward a first side portion E1 of one or more floated sheets and emits light from the light source 94*b* once toward a second side portion E2 of the floated sheets. Accordingly, in the side portion E2 of the picture, as illustrated in FIG. 15, only images of the sheets taken at the time of the light emission from the light source 94*b* are seen. From these images in the side portion E2 of the picture, the number of floated sheets becomes clear.

Then, according to the fourth modification, the positions of each of the floated sheets are figured out from the images seen in the side portion E1 of the picture in consideration of the moving speed of the sheets, the time interval between light emissions from the illuminating device 94, etc. in the same manner as in the second modification.

Fifth Modification

An image forming apparatus 1E according to a fifth modification is different from the image forming apparatus 1 according to the first embodiment mainly in the structure and the way of illumination of the illuminating device 94.

Figure 16:
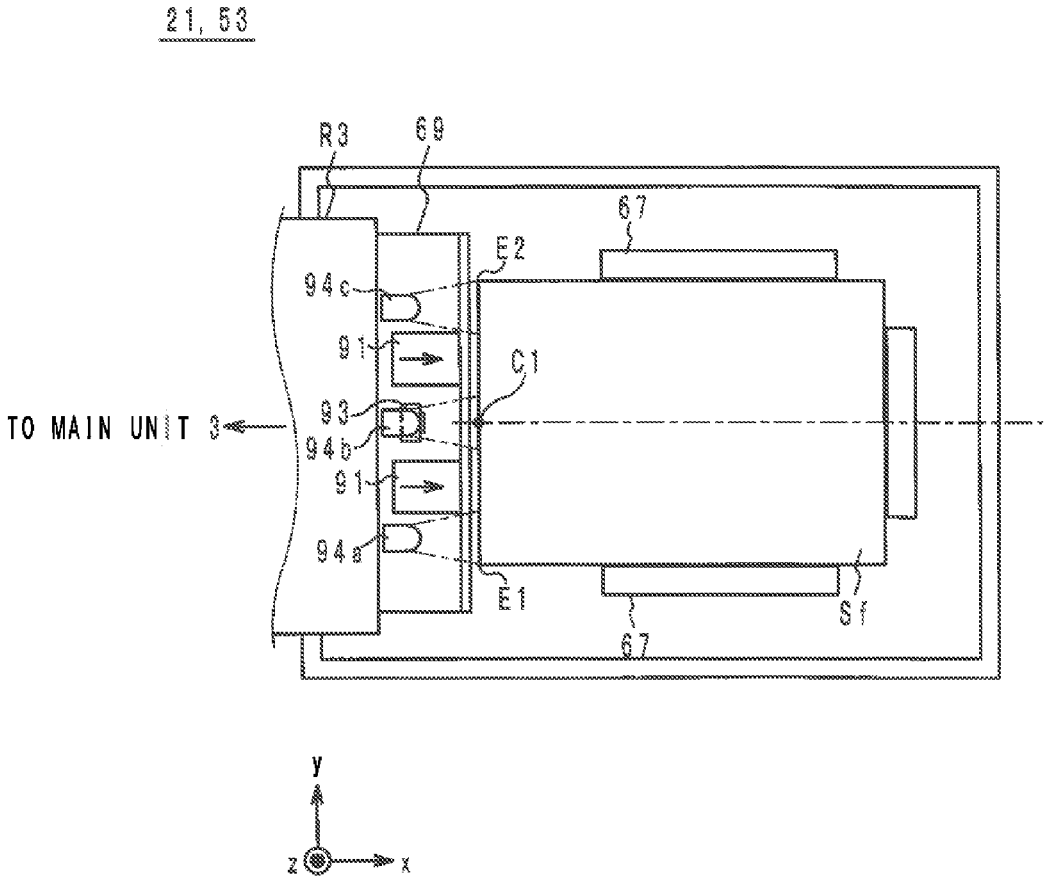
FIG. 16 is a schematic view of a sheet feeder according to a fifth modification, illustrating the internal structure thereof with the suction/feed system omitted.

According to the fifth modification, the illuminating device 94 includes three light sources 94*a*, 94*b* and 94*c* as illustrated in FIG. 16. The illuminating device 94 emits light from the three light sources 94*a*, 94*b* and 94*c* at different points of time during one-frame photographing toward different portions of the sheets in the lateral direction. For example, the frame rate of the photographic device 93 is 0.03 seconds. At a point of time that is 0.01 second after the start of one-frame photographing, the light source 94*a* emits light toward a first side portion E1 of one or more floated sheets. At a point of time that is 0.02 seconds after the start of one-frame photographing, the light source 94*b* emits light toward a center portion C1 of the floated sheets. Further, at a point of time that is 0.03 seconds after the start of one-frame photographing, the light source 94*c* emits light toward a second side portion E2 of the floated sheets.

Figure 17:
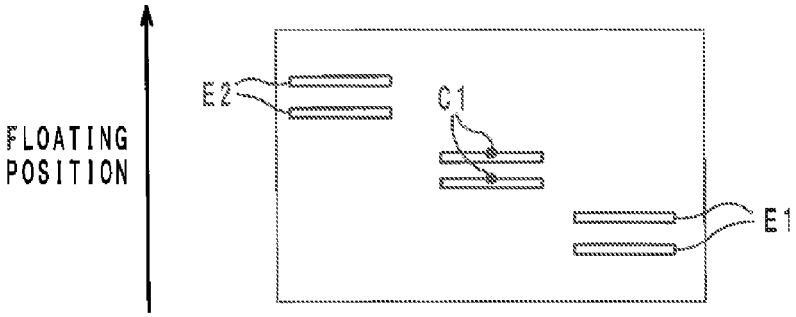
FIG. 17 is a pattern diagram of a picture of floated sheets taken by a photographic device of the sheet feeder according to the fifth modification.

In a picture taken in this way, as illustrated in FIG. 17, the floated sheets at different points of time are imaged in different positions in the lateral direction. Therefore, it is easy to perceive the number of floated sheets, and it is possible to detect the positions of each floated sheets without considering the amplitude of the movements of the sheets and other factors.

Sixth Modification

An image forming apparatus 1F according to a sixth modification is different from the image forming apparatus 1 according to the first embodiment mainly in the structure and the way of illumination of the illuminating device 94.

The illuminating device 94 emits light in different three colors. Light is emitted in different colors at different points of time during one-frame photographing. For example, the frame rate of the photographic device 93 is 0.03 seconds. At a point of time that is 0.01 second after the start of one-frame photographing, the illuminating device 94 emits blue light. At a point of time that is 0.02 seconds after the start of one-frame photographing, the illuminating device 94 emits red light.

Further, at a point of time that is 0.03 seconds after the start of one-frame photographing, the illuminating device 94 emits green light.

Figure 18:
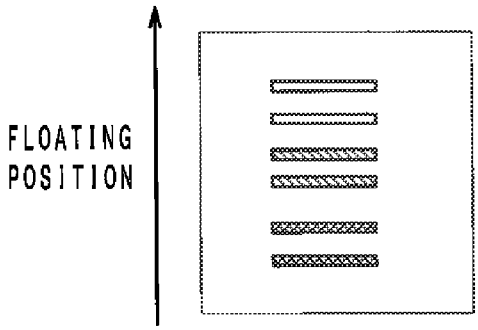
FIG. 18 is a pattern diagram of a picture of floated sheets taken by a photographic device of the sheet feeder according to the sixth modification.

In a picture taken in this way, as illustrated in FIG. 18, images of the sheets taken at a point of time are in the same color, and it is easy to perceive the number of floated sheets. Also, it is easy to perceive the positions of each floated sheets from the number of sheets and the colors in the picture. Thus, it is possible to detect the positions of each floated sheets without considering the amplitude of the movements of the sheets and other factors. In FIG. 18, the difference in color is indicated by the difference in the hatching.

Other Embodiments

Sheet feeders and image forming apparatuses according to the present invention are not limited to the embodiment and the modifications above. For example, the number of light sources of the illuminating device and the positions of the light sources may be arbitrarily designed in accordance with the size and/or the structure of the sheet feeder. The time interval between light emissions from the illuminating device may be designed to be shorter. Further, it is possible to combine the embodiment and the modifications.

Although the present invention has been described in connection with the preferred embodiments above, it is to be noted that various changes and modifications may be obvious to those who are skilled in the art. Such changes and modifications are to be understood as being within the scope of the present invention.

What is claimed is:

1. A sheet feeder comprising:

a base portion configured to support thereon a stack of sheets piled on top of another;

a blower configured to blow air to the stack of sheets supported on the base portion so as to float one or more sheets in an uppermost portion of the stack of sheets;

a suction/feed system located above the base portion, the suction/feed system configured to suck the sheet floated by the blower and to feed the sheet in a predetermined feeding direction;

a photographic device configured to take a picture of the one or more sheets floated by the blower; and an illuminating device configured to emit light to the one or more sheets floated by the blower a plurality of times during one exposure process carried out by the photographic device.

2. The sheet feeder according to claim 1, wherein the illuminating device is capable of emitting light in a plurality of colors.

3. The sheet feeder according to claim 1, wherein the illuminating device is configured to emit light to different portions of the one or more floated sheets with respect to a horizontal direction.

4. The sheet feeder according to claim 3, wherein the illuminating device includes a plurality of light sources located at positions corresponding to the different portions of the one or more floated sheets with respect to a horizontal direction.

5. The sheet feeder according to claim 1, wherein the illuminating device includes a plurality of light sources.

6. The sheet feeder according to claim 5, wherein:

a first light source of the plurality of light sources is configured to emit light once during one exposure process carried out by the photographic device; and a second light source of the plurality of light sources is configured to emit light a plurality of times during one exposure process carried out by the photographic device.

7. An image forming apparatus comprising, the sheet feeder according to claim 1.

8. The image forming apparatus according to claim 7, further comprising a control circuit configured to detect a position of each of the one or more sheets floated by the blower from a picture taken by the photographic device, wherein the control circuit is configured to adjust an air volume from the blower based on a detection result of the position of each of the one or more sheets floated by the blower.

9. The image forming apparatus according to claim 7, further comprising a control circuit configured to detect a position of each of the one or more sheets floated by the blower from a picture taken by the photographic device, wherein:

the base portion is movable up and down; and the control circuit adjusts a position of the base portion based on a detection result of the position of each of the one or more sheets floated by the blower.

* * * * *